United States Patent [19]

Williams

[11] Patent Number: 4,648,442

[45] Date of Patent: Mar. 10, 1987

[54] STAKE FOR A TUBE BUNDLE

[76] Inventor: George J. Williams, 36 Hickory La., Chalfont, Pa. 18914

[21] Appl. No.: 807,312

[22] Filed: Dec. 10, 1985

[51] Int. Cl.[4] ..... F28F 1/00

[52] U.S. Cl. ..... 165/162; 165/172; 248/68.1

[58] Field of Search ..... 165/162, 172; 248/68.1; 122/510

[56] References Cited

U.S. PATENT DOCUMENTS

| | | | |
|---|---|---|---|
| 2,231,462 | 2/1941 | Cobb | 165/162 |
| 2,317,572 | 4/1943 | Whitt et al. | 165/172 |
| 3,163,208 | 12/1964 | Cuzzone et al. | 165/162 X |
| 3,180,597 | 4/1965 | Havener | 248/68.1 |
| 3,820,594 | 6/1974 | Ritland et al. | 165/162 X |
| 4,220,199 | 9/1980 | Romanos | 165/172 |
| 4,286,654 | 9/1981 | Ruhe | 165/172 |
| 4,289,198 | 9/1981 | Young | 165/159 |

FOREIGN PATENT DOCUMENTS

| | | | |
|---|---|---|---|
| 85723 | 9/1958 | Denmark | 248/68 R |
| 835607 | 4/1952 | Fed. Rep. of Germany | 165/162 |
| 2921406 | 12/1980 | Fed. Rep. of Germany | 165/162 |
| 1401292 | 12/1965 | France | 165/162 |
| 52981 | 8/1942 | Netherlands | 165/162 |
| 339751 | 6/1972 | U.S.S.R. | 165/172 |

*Primary Examiner*—Albert W. Davis, Jr.

*Attorney, Agent, or Firm*—Joseph W. Molasky & Assocs.

[57] ABSTRACT

A stake of U-shaped cross-section which, when inserted in a tube bundle between parallel rows of tubes, dampens vibrations and provides support. One stake end is arcuately shaped for engagement with the end tube in a tube row and in one embodiment an aperture is provided to accommodate a restraint which retains the stakes in series in their engagement mode.

11 Claims, 4 Drawing Figures

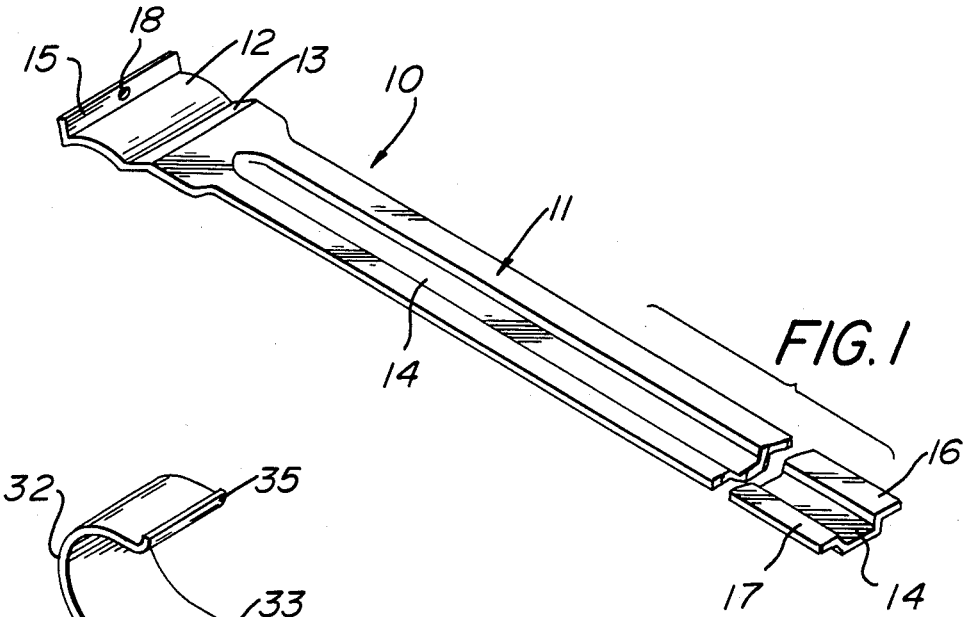
FIG. 1
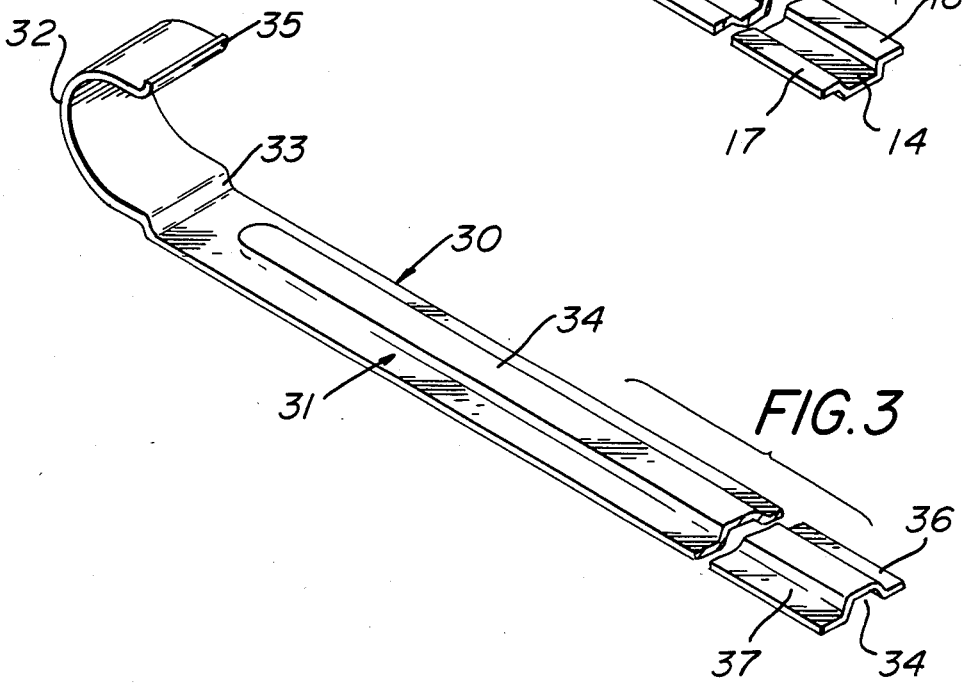
FIG. 3
FIG. 4
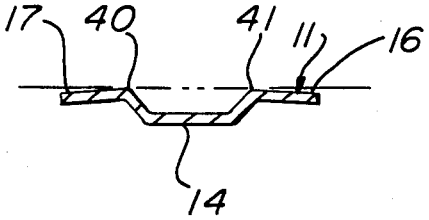

STAKE FOR A TUBE BUNDLE

This invention relates to a support stake which may be incorporated into a tube bundle during construction or added to an already existing tube bundle system.

Tube bundles are used in heat exchangers to carry fluids over a wide range of temperatures and pressures; however, as temperatures increase and the density and velocity of the fluids change the tubes respond to these changes by giving rise to critical vibrations. Moreover, when the vibrations are severe known stakes have a tendency to slide into the center of the tube bundle and become lost. The stakes of this invention are designed to dampen these vibrations and minimize the damage which may result when oscillations reach critical amplitudes.

The present invention provides a stake having a longitudinal channel or die-formed upset which allows any spacing between tubes to be accommodated without increasing material thickness.

One end of this stake includes an arcuate segment which is contoured to fittingly engage the end tube in the tube row. This engagement locks the stake in place so that it cannot become dislodged regardless of the vibrations or contractions which occur.

Accordingly, the present invention constitutes an advance in the art because it maintains parallel rows of tubes in a spaced-apart relationship in an economical and efficacious manner, without adding significantly to the weight of the tube bundle.

BACKGROUND

Conventional wisdom suggests that the degree and frequency of vibrations can be reduced or avoided by inserting strips, rods or beams within the lanes between tube rows but in most instances this remedy has given rise to a new set of problems.

In British Patent No. 1,223,045, Robert Valluy describes a system of intersecting strips which form a honeycomb structure of rectangular cells. The object here is to eliminate those vibrations which create the most dangerous amplitudes and contribute most to structural damage.

Although Valluy achieves this basic goal he creates a new problem by making the system dependent on an intricate design which not only adds to the weight of the tube assembly but increases manufacturing costs, impedes fluid flow and lessens operating efficiencies.

In U.S. Pat. No. 4,143,709, Richard Cunningham has sought to improve on the Valluy design by employing two supporting assemblies through which the tubes of a tube bundle pass in a spaced-apart relationship. In practice, these assemblies enhance fluid flow and achieve the desired result to some degree but the cost of fabricating and installing this system is so expensive and the weight which they impose on existing structures is so appreciable that the system is impractical. Moreover, the Cunningham apparatus must be built into prospective heat exchange systems and cannot be incorporated into already existing structures.

Accordingly, there is a need for an effective support and vibration suppressing system which can be incorporated into existing assemblies without adding appreciably to their overall weight or cost.

THE INVENTION

It is an object of this invention to describe a novel elongated device or stake which can be inserted between rows of tubes in existing tube bundle systems so as to suppress the oscillating effects caused by the internal and external flow of fluids.

Another object is to provide a system in which a plurality of stakes are incorporated into a tube bundle as it is being constructed so as to dampen vibrations and protect against premature tube failure.

Although it is known in this field to insert strips between adjacent tube rows to prevent them from colliding and inflicting structural damage the clearances between rows is not always constant and, therefore, it is necessary to specially design and custom fit said strips so that they can fill the lanes and suppress the oscillating effects created by these assemblies.

The present invention overcomes these difficulties by providing stakes which are fabricated from sheet material of a single guage thickness so that their size and weight will not add appreciably to the weight of the system.

Moreover, the stakes of this invention always provide a custom fit because they include a die-formed upset or channel which conforms essentially to the distance between adjacent tube rows or to a pre-determined additional thickness so as to create a degree of pre-load or interference.

Pre-load occurs when stakes are inserted in a lane between two adjacent tube rows but not in a succeeding lane so that in effect the succeeding lane will remain open. Interference means that dimension or condition of the stake which goes beyond its design limits and creates stress or flex within the piece.

Structurally, the elongated device or stake of this invention comprises: (1) a longitudinal segment containing a die-formed upset or channel, (2) a terminal arcuate segment having a curvature which corresponds essentially to the surface of the tubes within the tube bundle; and (3) a connecting member which lies at an oblique angle to said longitudinal segment and joins the latter to said arcuate segment.

The ability of the present stake to fill the lanes between tube rows is made possible by the die-formed upset or channel which characterizes the longitudinal segment. In practice, the thickness or depth of this channel, that is, the distance from the top surface of the stake to the bottom channel surface, is essentially identical to the distance between the tubes in adjacent tube rows or it is equal to that distance plus the degree of interference determined necessary.

By controlling the depth of the channel the inserted stakes have the ability to fill the lanes and come into nodal contact with the tube surfaces of each tube in each row. This disposition gives added rigidity to the bundle and prevents the stakes from colliding with one another.

Moreover, the U-shaped channel or upset gives rigidity to the longitudinal segment and allows them to be extended entirely into the tube bundle without impairment. The stake surfaces are smooth and slightly flared so as to enhance their insertion within the bundle and avoid structural damage.

One terminal end portion of the present stake has a basically arcuate design which corresponds essentially to the curvature of the tubes within the bundle so that it can be brought into registry with a tube surface. In their assembled mode the stakes are inserted into the tube bundle in series and their respective arcuate segments are brought into registered engagement with the curved surface of each end tube in each tube row. This engagement locks each stake into place, enhances its vibration-suppressing ability and affords a more rigid assembly.

The stakes of this invention may be extended entirely into the tube bundle between adjacent rows or they may be inserted only partially as needed in a diagonal, horizontal or vertical mode.

The stakes of this invention may be fabricated from any durable and fracture-resistant material but stainless steel is preferred because it combines the advantages of strength and fracture toughness with a resistance to atmospheric oxidation over extended periods.

These and other aspects of the invention are best understood by reference to the Drawings and embodiments which will now be described in detail.

THE DRAWINGS

FIG. 1 is a broken perspective view showing a tube support stake in accordance with this invention.

FIG. 3 is a fragmentary perspective view of a second support stake in accordance with this invention.

FIG. 4 is a cross sectional view of the stake shown in FIG. 2 along line 4—4.

THE EMBODIMENTS

Figure 2:
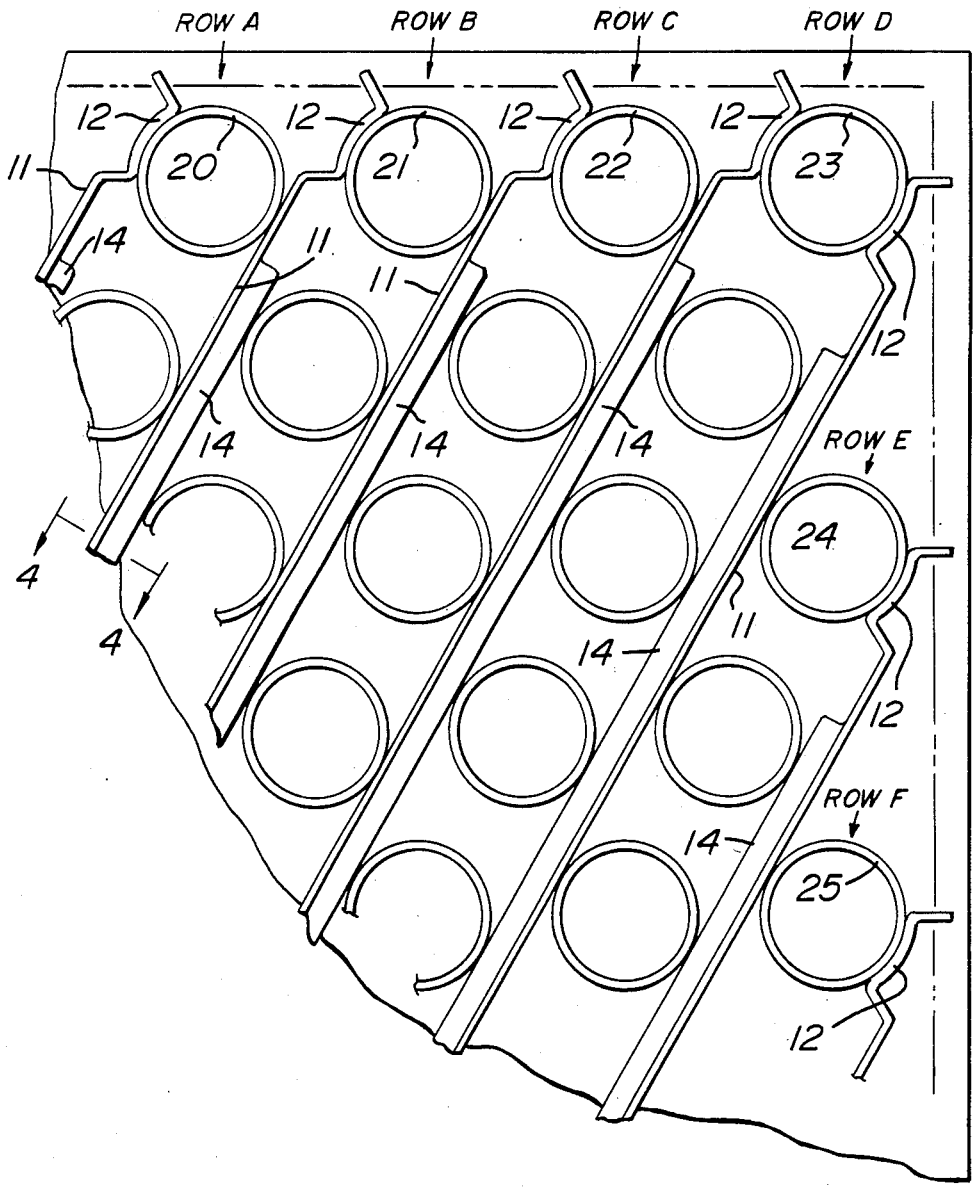
FIG. 2 is a fragmentary side view illustrating the diagonal engagement of the stake of FIG. 1 with tubes in a tube bundle.

The present invention is illustrated by FIG. 1 which shows in detail the top and side surfaces of a die-impressed stake for a tube bundle. In this embodiment stake 10 consists essentially of a longitudinal segment 11, an arcuate segment 12 and a connecting member 13. All surfaces are smooth so that the stake can be inserted into the lanes between adjacent parallel rows without scoring, abrading or otherwise inflicting damage.

Impressed into the top surface of the stake is a die-formed upset in the form of a recess or channel 14 which extends approximately the entire length of segment 11.

The stakes are formed from sheets of uniform guage metal, preferably, Austenitic Stainless Steel or 304 Stainless Steel and their thickness is determined by the depth of channel 14. Accordingly, the stakes can be tailor-made to any thickness by impressing into the longitudinal segment a die-formed recess or channel which is equal in depth to the distance between adjacent rows.

The longitudinal segment 11 consists of a U-shaped channel 14 bounded on opposite sides by transverse members 16 and 17. These members extend outwardly from said channel with an obliquity that is barely perceptible from FIG. 1; however, the enlarged cross-section of channel 14, as shown in FIG. 4, clearly demonstrates the extent of this declivity. This configuration has the effect of limiting the stake contact points so that within a bundle only areas 40 and 41 come into engagement with the facing tubes in a tube row. As a result, it has been found that the stakes of this invention can be inserted into a tube bundle with greater ease and less damage than was heretofore possible.

Moreover, the U-shaped configuration of channel 14 contributes to its torsional strength as a result of which the stakes can be forcibly inserted into a tube bundle as deeply as necessary without impairment.

The arcuate segment 12 is characterized by a curvature which corresponds essentially to the curvature of the end tube in a tube bundle. In its application this segment comes into registry with the end tube and locks onto the tube surface to provide an enhanced support means.

The terminal portion 15 includes an aperture 18 through which a rod or stiff wire may be inserted. The threading of such a restraint through the aperture of each stake in series provides a means for retaining the stakes in position so that no one of them can slide into the tube bundle and become lost.

In FIG. 3 there is illustrated a stake 30 in which the longitudinal segment 31 is also characterized by an arcuate segment 32, a terminal end portion 35 and a connecting member 33; however, the arcuate segment of this embodiment extends in curvilinear fashion for approximately 180° so as to form a crook-like member. This member is of such prominence that it fittingly engages an end tube and the engagement is so secure that the oscillating effects of the bundle cannot dislodge it from its fitted position. Impressed into longitudinal segment 31 is a U-shaped channel 34 with transversely extending members 36 and 37.

FIG. 2 is a fragmentary section showing a conventional tube bundle with the stakes disposed in a fully extended mode within diagonal lanes; however, it will be appreciated by those skilled in the art that this orientation is merely illustrative of the manner in which the stakes may be employed and, in practice, they may also be disposed in a horizontal and vertical mode.

The thickness of each stake is essentially equal to the distance between adjacent tube rows, that is, the distance needed to provide interference and, therefore, each stake fills its respective lane to the extent that its top surface is in nodal contact with each tube in an upper row while its bottom surface is in simultaneous contact with the tubes of an immediately lower row. Moreover, in their fully extended mode, as shown, the arcuate segments are in registry with the end tube in each tube row.

This invention will now be illustrated by describing the step-wise introduction of stakes into a tube bundle of diagonal orientation of the type shown in FIG. 2; however, it is to be understood that this procedure applies equally to tube bundles of horizontal and vertical orientation.

According to this procedure the stakes are inserted into the lanes between Rows A-B, B-C and C-D until their respective arcuate segments 12 come into registry with end tubes 20, 21, 22 and 23. This procedure is repeated conversely for Rows D-E and E-F with the arcuate segments 12 being brought into engagement with end tubes 23, 24, 25.

By following this procedure throughout the bundle all tubes can be brought into nodal contact with a stake surface. In Rows A, B, C, E and F this contact occurs between channel member 14 and longitudinal segment 11, whereas, in Row D contact occurs between the channel members of opposing stakes in adjacent lanes.

This invention has been described by reference to precise embodiments but it will be appreciated by those skilled in the art that this invention is subject to various modifications and to the extent that these would be obvious to one of ordinary skill they are within the scope of the appended claims.

What is claimed is:

1. An elongated stake for maintaining the tubes of a tube bundle in a spaced apart relationship which comprises:

(1) a longitudinal segment having a top surface and a bottom surface characterized by a channel of generally U-shaped cross-section which extends approximately the length of said segment, said channel being bounded on opposite sides by obliquely disposed flat members which extend outwardly from said channel;

(2) a generally arcuate segment for engaging a section of a tube in said tube bundle; and (3) a flat and obliquely disposed connecting member which joins said longitudinal segment to said arcuate segment.

2. The stake according to claim 1 wherein said U-shaped channel has a thickness corresponding minimally to the distance between adjacent tube rows in a tube bundle.

3. The stake according to claim 1 wherein said arcuate segment terminates in a flat end portion which extends upwardly at an oblique angle.

4. The stake according to claim 3 wherein said end portion includes an aperture through which a rigid restraint may be secured.

5. The stake according to claim 1 wherein said arcuate segment is contoured to a curvature of approximately 180°.

6. A method for supporting tubes in a tube bundle having rows of parallel tubes arranged in series which comprises, extending in the lanes between adjacent tube rows a stake according to claim 1 so that each tube in each tube row is in contact with a surface of said stake.

7. A system for maintaining parallel rows of tubes in a tube bundle in a spaced-apart relationship which comprises: a plurality of elongated stakes disposed in series between adjacent rows, said stakes consisting essentially of:

(1) a longitudinal segment having a top surface and a bottom surface characterized by a channel of generally U-shaped cross-section which extends approximately the length of said segment, said channel being bounded on opposite sides by obliquely disposed flat members which extend outwardly from said channel;

(2) a generally arcuate segment for engaging a section of a tube in said tube bundle; and (3) a flat and obliquely disposed connecting member which joins said longitudinal segment to said arcuate segment.

8. The system of claim 7 wherein said U-shaped channel has a thickness corresponding minimally to the distance between adjacent tube rows.

9. The system of claim 7 wherein the arcuate segment terminates in a flat end portion which is characterized by an aperture through which a rigid restraint may be secured.

10. The system of claim 7 wherein the arcuate segment is contoured to a curvature of approximately 180°.

11. The system of claim 7 wherein said stakes are diagonally extended within said bundle.

* * * * *